US008086136B2

(12) United States Patent
Hayashi

(10) Patent No.: US 8,086,136 B2
(45) Date of Patent: Dec. 27, 2011

(54) PHOTORECEPTOR UNIT AND IMAGE FORMING APPARATUS

(75) Inventor: Hideji Hayashi, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 76 days.

(21) Appl. No.: 12/604,430

(22) Filed: Oct. 23, 2009

(65) Prior Publication Data

US 2010/0142992 A1 Jun. 10, 2010

(30) Foreign Application Priority Data

Dec. 5, 2008 (JP) ..... 2008-311002

(51) Int. Cl.
*G03G 21/16* (2006.01)

(52) U.S. Cl. ..... 399/111; 399/116

(58) Field of Classification Search ..... 399/111, 399/114, 116
See application file for complete search history.

(56) References Cited

U.S. PATENT DOCUMENTS

| | | | |
|---|---|---|---|
| 6,993,267 | B2 | 1/2006 | Yoshiyuki et al. |
| 7,383,000 | B2 | 6/2008 | Koumoto et al. |
| 7,929,881 | B2 | 4/2011 | Yoshino et al. |
| 2007/0230997 | A1 | 10/2007 | Matsui |

FOREIGN PATENT DOCUMENTS

| | | | |
|---|---|---|---|
| JP | 05-257412 | | 10/1993 |
| JP | 09-127851 | | 5/1997 |
| JP | 2004-170556 | | 6/2004 |
| JP | 2004-170904 | | 6/2004 |
| JP | 2005-037463 | | 2/2005 |
| JP | 2006-267808 | A | 10/2006 |
| JP | 2007-271759 | A | 10/2007 |
| JP | 2008-170960 | | 7/2008 |

OTHER PUBLICATIONS

Notice of Grounds of Rejection dated Jul. 20, 2010, issued in the corresponding Japanese Patent Application No. 2008-311002, and an English Translation thereof.

Office Action (Decision to Grant Patent) dated Aug. 30, 2011, issued in the corresponding Japanese Patent Application No. 2008-311002, and an English Translation thereof.

*Primary Examiner* — Hoang Ngo

(74) *Attorney, Agent, or Firm* — Buchanan Ingersoll & Rooney PC

(57) ABSTRACT

A photoreceptor unit is inserted into an image forming apparatus in the predetermined insertion direction, and includes a photoreceptor, a light-shielding sheet covering a part of the photoreceptor on the front side in the insertion direction; a rigid cover made of resin and provided adjacent to the light-shielding sheet on the rear side in the insertion direction; and a cushioning member interposed between the rigid cover and the photoreceptor. The rigid cover has a length that allows the photoreceptor unit to be gripped at the rigid cover. The light-shielding sheet, the rigid cover and the cushioning member can be removed together from the photoreceptor.

13 Claims, 7 Drawing Sheets

PHOTORECEPTOR UNIT AND IMAGE FORMING APPARATUS

This application is based on Japanese Patent Application No 2008-311002 filed with the Japan Patent Office on Dec. 5, 2008, the entire content of which is hereby incorporated by reference.

BACKGROUND OF THE INVENTION

1. Field of the Invention

The present invention relates to a photoreceptor unit and an image forming apparatus, and particularly to a photoreceptor unit inserted into an image forming apparatus in a predetermined insertion direction and the image forming apparatus.

2. Description of the Related Art

Japanese Laid-Open Patent Publication No. 2006-267808 (Document 1) discloses a process cartridge for a printer and the like provided with a cover member having a two-layered structure which includes a cushioning sheet protecting a photoreceptor drum and shielding the photoreceptor drum from light, and a cover sheet removed from a cartridge body together with the cushioning sheet at the time when the cartridge body strikes against the external wall of the body of an image forming apparatus.

Furthermore, Japanese Laid-Open Patent Publication No. 2007-271759 (Document 2) discloses that the sheet-shaped packaging material enclosing a process cartridge is connected to a separation cover that is detachably attached to the body frame of the process cartridge.

When a photoreceptor unit including a photoreceptor drum is inserted into an image forming apparatus, it is desirable to provide a rigid cover that is resistant to the pressure applied by the user's operation in order to protect the photoreceptor drum from the applied pressure. However, it is not preferable in terms of resource saving to provide a rigid cover on the entire photoreceptor drum.

The process cartridge disclosed in Document 1 includes a cover member formed only of a sheet-shaped member, which is completely different in precondition and configuration from the present invention provided with a rigid cover member.

Furthermore, the process cartridge disclosed in Document 2 aims at reducing distortion and sliding friction of a charging roll, and does not necessarily serve to fully solve the above-described problems.

SUMMARY OF THE INVENTION

An object of the present invention is to provide a photoreceptor unit which facilitates convenient handling at the time of exchange, allows sufficient protection of a photoreceptor and also allows resource saving, and an image forming apparatus provided with the photoreceptor unit.

A photoreceptor unit according to the present invention which is, in one aspect, inserted into an image forming apparatus in a predetermined insertion direction includes a photoreceptor; a light-shielding sheet covering a part of the photoreceptor on a front side in the insertion direction; a rigid cover provided in one of a state where the rigid cover is adjacent to the light-shielding sheet on a rear side in the insertion direction and a state where the rigid cover overlaps a part of the light-shielding sheet; and a cushioning member interposed between the rigid cover and the photoreceptor. The rigid cover has a length allowing the photoreceptor unit to be gripped at the rigid cover. The light-shielding sheet, the rigid cover and the cushioning member are capable of being removed together from the photoreceptor.

It is to be noted that the "rigid cover" described in the specification of the present application means a cover having a hardness that is resistant to the pressure applied by the user's operation at the time when the photoreceptor unit is exchanged.

According to one embodiment, in the above-described photoreceptor unit, the photoreceptor is covered entirely in an axial direction with the light-shielding sheet and the rigid cover.

According to one embodiment, the photoreceptor unit is provided separately from a developing unit for developing an electrostatic latent image formed on the photoreceptor.

According to one embodiment, in the above-described photoreceptor unit, more than half of a surface of the photoreceptor is exposed in a state where the light-shielding sheet, the rigid cover and the cushioning member are removed.

According to one embodiment, in the above-described photoreceptor unit, a flange portion is formed at an end of the rigid cover, and the flange portion is capable of preventing the photoreceptor unit equipped with the rigid cover from being excessively inserted into the image forming apparatus.

According to one embodiment, in the above-described photoreceptor unit, the rigid cover has an axial length of not less than one-third and not more than two-thirds of an entire length of the photoreceptor.

A photoreceptor unit according to the present invention which is, in another aspect, inserted into an image forming apparatus in a predetermined insertion direction includes a photoreceptor; a housing pivotally supporting the photoreceptor such that the photoreceptor can rotate and covering the photoreceptor in a state where at least a part of the photoreceptor is exposed; a light-shielding sheet located in the photoreceptor on a front side in the insertion direction and detachably attached to the housing so as to cover a portion of the photoreceptor exposed from the housing; a rigid cover connected to the light-shielding sheet, located in the photoreceptor on a rear side in the insertion direction and detachably attached to the housing so as to cover a portion of the photoreceptor exposed from the housing; and a cushioning member interposed between the rigid cover and the photoreceptor.

According to one embodiment, in the above-described photoreceptor unit, a part of a circumference of the photoreceptor is exposed entirely in an axial direction from the housing.

According to one embodiment, the above-described photoreceptor unit further includes a cleaning unit attached to the housing and scraping toner off a peripheral surface of the photoreceptor.

According to one embodiment, the above-described photoreceptor unit further includes a cleaning unit attached to the housing and scraping toner off a peripheral surface of the photoreceptor; and an electrostatic charging unit attached to the housing and electrostatically charging the photoreceptor.

According to one embodiment, a flange portion is formed at an end of the rigid cover, and the flange portion is capable of preventing the photoreceptor unit equipped with the rigid cover from being excessively inserted into the image forming apparatus.

An image forming apparatus according to the present invention includes the above-described photoreceptor unit.

According to the present invention, a photoreceptor unit facilitating convenient handling at the time of exchange, allowing sufficient protection of a photoreceptor and also allowing resource saving can be provided, as will be hereinafter described in greater detail.

First, as a rigid cover and a cushioning member are provided on a photoreceptor, the photoreceptor can be protected from the pressure applied by the user's operation. In this case, the portion of the photoreceptor that is not provided with the rigid cover is covered with a light-shielding sheet, which allows the photoreceptor to be protected from light. The rigid cover employed as a grip can facilitate convenient handling at the time when the photoreceptor is exchanged. As the rigid cover is provided in the photoreceptor unit on the front side in the insertion direction and the light-shielding sheet is provided on the rear side thereof in such a manner that the rigid cover and the light-shielding sheet can be removed together, it becomes possible to grip the rigid cover and insert the photoreceptor into the image forming apparatus without removing the light-shielding sheet. Furthermore, resource saving can also be achieved as compared with the case where the photoreceptor is covered entirely in the axial direction with the rigid cover.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
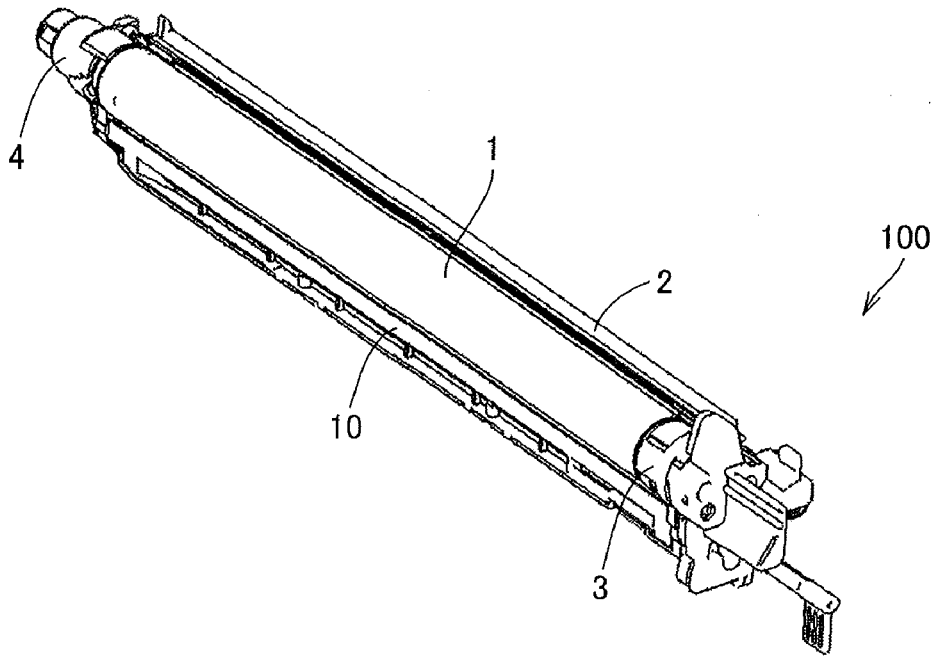
FIG. 1 is a diagram showing the state after removal of the packaging material of a photoreceptor unit according to one embodiment of the present invention.

The embodiments of the present invention will be hereinafter described with reference to the accompanying drawings, in which the same or corresponding components are designated by the same reference characters, and description thereof may not be repeated.

With regard to the embodiments described below, in the case where reference is made to the number of elements, amount or the like, the scope of the present invention is not necessarily limited thereto unless otherwise specified. Also in the embodiments described below, each component is not necessarily essential to the present invention unless otherwise specified.

Figure 2:
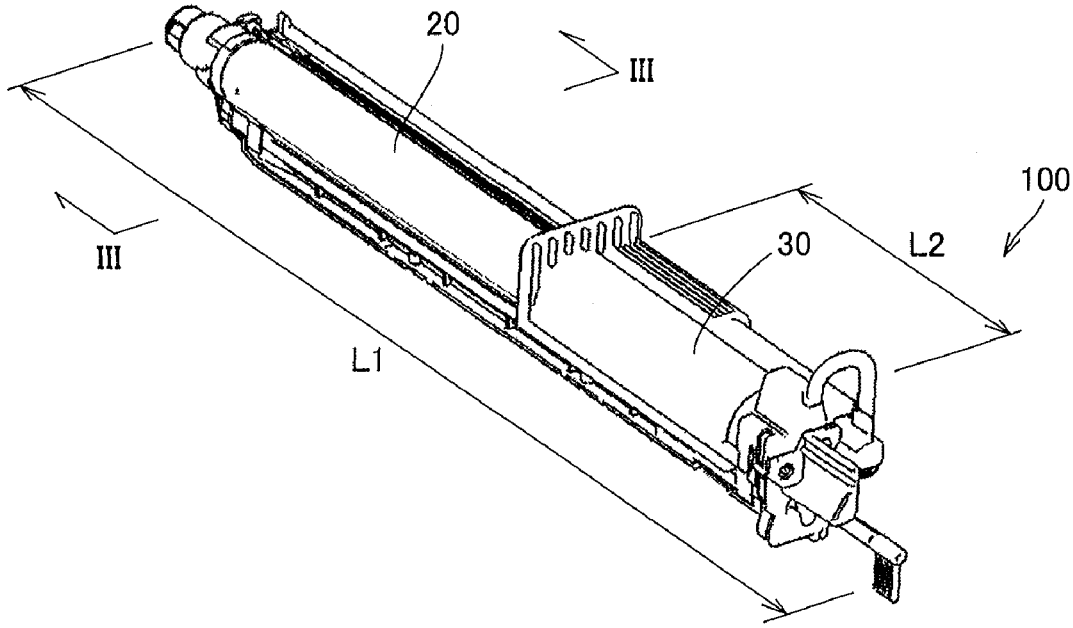
FIG. 2 is a diagram showing the state before removal of the packaging material of a photoreceptor unit according to one embodiment of the present invention.
Figure 3:
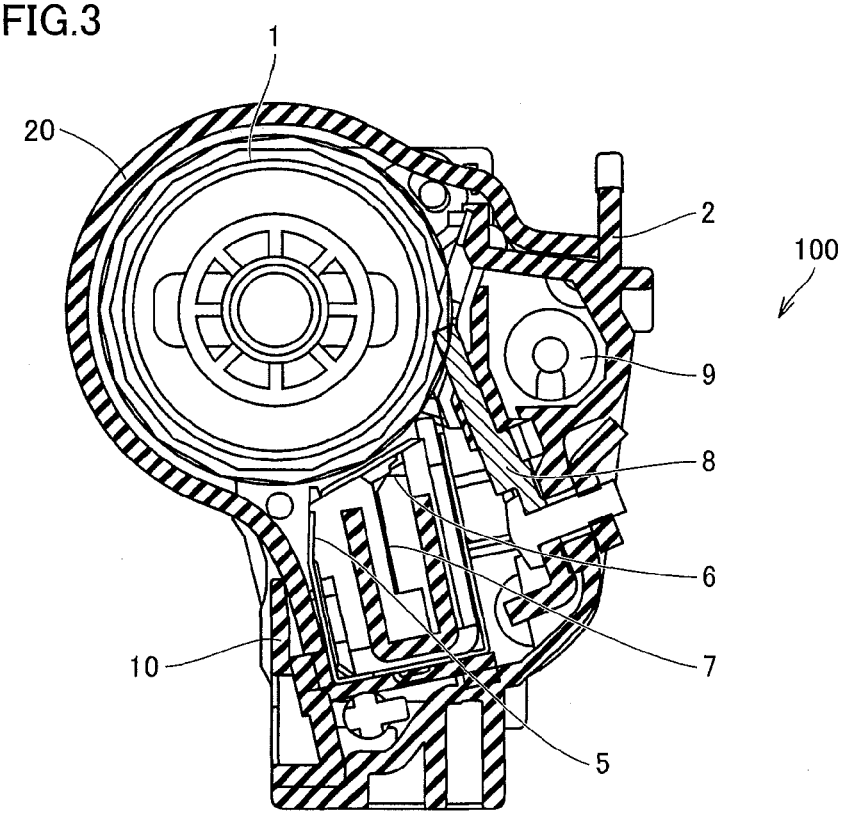
FIG. 3 is a cross sectional view of a photoreceptor unit according to one embodiment of the present invention taken along line III-III in FIG. 2.

FIG. 1 is a diagram showing the state after removal of the packaging material of a photoreceptor unit 100 according to one embodiment of the present invention. FIG. 2 is a diagram showing the state before removal of the packaging material of photoreceptor unit 100. FIG. 3 is a cross sectional view of photoreceptor unit 100 taken along line III-III in FIG. 2.

Referring to FIGS. 1-3, a photoreceptor unit 100 includes a photoreceptor 1, a housing 2, bearing 3 and 4, a charger stabilizing plate 5, a charger mesh 6, a charger needle 7, a cleaner blade 8, a waste toner transport unit 9, and a side cover 10.

Photoreceptor 1 is pivotally supported by bearings 3 and 4 rotatably with respect to housing 2. A part of photoreceptor 1 is exposed from housing 2. The exposed region of photoreceptor 1 exists entirely in the axial direction thereof. In the vicinity of photoreceptor 1, a charging area including charger stabilizing plate 5, charger mesh 6 and charger needle 7, an exposure area (not shown), a development area (not shown), a transfer area (not shown), and a cleaning area including cleaner blade 8 and waste toner transport unit 9 are provided. Cleaner blade 8 serves to remove the toner which is not transferred onto the transfer material but remains on the surface of photoreceptor 1. Charger stabilizing plate 5, charger mesh 6 and charger needle 7 constitute an "electrostatic charging unit", and cleaner blade 8 is a component of a "cleaning unit".

Photoreceptor unit 100 according to the present embodiment is provided separately from a developing unit. Since the above-mentioned photoreceptor unit carries out exposure, development and transfer in cooperation with the elements disposed outside the unit, a relatively large area on the surface of photoreceptor 1 is exposed to the outside. Specifically, in the present embodiment, more than half of the surface area of photoreceptor 1 (in a more typical example, 60% or more) is exposed to the outside. Therefore, it becomes important to prevent photoreceptor 1 from being damaged by light when the user of the image forming apparatus exchanges photoreceptor unit 100.

Photoreceptor unit 100 according to the present embodiment is provided with a light-shielding sheet 20 and a rigid cover 30 made of resin, which cover the surface of photoreceptor 1.

Light-shielding sheet 20 is provided in photoreceptor unit 100 on the front side in the direction to which photoreceptor unit 100 is inserted. Rigid cover 30 is provided in photoreceptor unit 100 on the rear side in the direction to which photoreceptor unit 100 is inserted. Rigid cover 30 has an axial length (L2) of not less than one-third and not more than two-thirds of an entire length (L1) of photoreceptor 1. This allows rigid cover 3 to cover the vicinity of the physical center of gravity of photoreceptor unit 100. Consequently, it becomes possible to grip rigid cover 3 to facilitate the handling of photoreceptor unit 100.

Rigid cover 30 is connected to light-shielding sheet 20. Three sides of rigid cover 30 other than that connected to light-shielding sheet 20 are fit in housing 2 and side cover 10, which causes rigid cover 30 to be positioned. As rigid cover 30 is pulled upward as seen in FIGS. 2 and 3, rigid cover 30 can be removed from photoreceptor unit 100 together with light-shielding sheet 20.

A part of light-shielding sheet 20 is fixed to each of housing 2 and side cover 10. Each fixed portion is perforated to facilitate removal of light-shielding sheet 20 from housing 2 and side cover 10.

Photoreceptor unit 100 provided separately from the developing unit is required to be inserted into a relatively narrow space. In this case, if photoreceptor unit 100 is entirely covered with rigid cover 3, it becomes necessary to ensure a space for temporarily accommodating rigid cover 3 that is not used after insertion of photoreceptor unit 100, which may lead to an increase in size of the image forming apparatus.

In contrast, in photoreceptor unit 100 according to the present embodiment, light-shielding sheet 20 and rigid cover 30 are arranged as described above to thereby allow photoreceptor 1 to be protected from light, and rigid cover 30 is used as a grip to thereby also allow the handling at the time of exchange to be facilitated. It is to be noted that rigid cover 30 is formed of the material having a hardness enough to resist deformation when it is gripped by the user (for example, polypropylene and the like).

Figure 4:
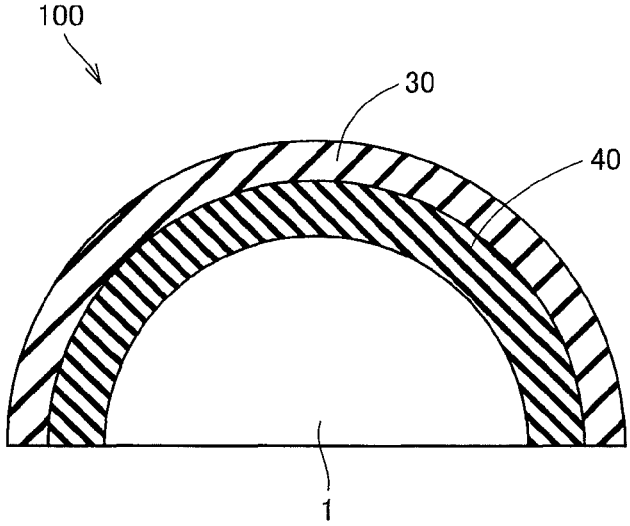
FIG. 4 is a schematic diagram showing a cross section of a portion where a rigid cover is located in a photoreceptor unit according to one embodiment of the present invention.

Rigid cover 30 mounted on photoreceptor unit 100 has a portion which is connected to light-shielding sheet 20 but is not supported by housing 2 and side cover 10. Therefore, in the case where rigid cover 30 is only provided on photoreceptor 1, photoreceptor 1 may be damaged when rigid cover 30 is gripped. Accordingly, in photoreceptor unit 100 according to the present embodiment, as shown in FIG. 4, a cushioning member 40 is provided between photoreceptor 1 and rigid cover 30 so as to protect photoreceptor 1. Cushioning member 40 is formed of material such as sponge and the like which allows absorption of the pressing force exerted by rigid cover 30.

Figure 6:
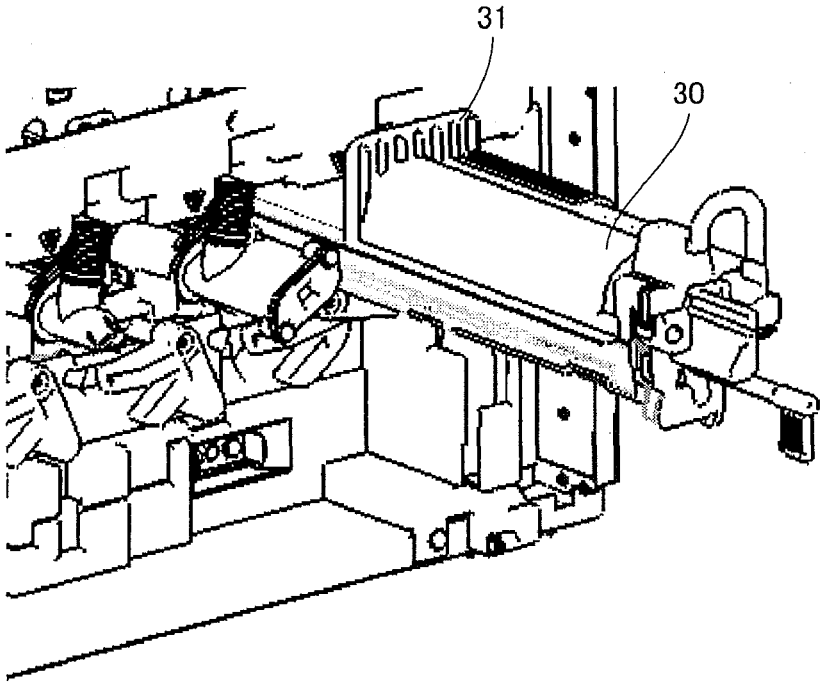
FIG. 6 is a diagram showing the second step of inserting a photoreceptor unit according to one embodiment of the present invention into an image forming apparatus.
Figure 7:
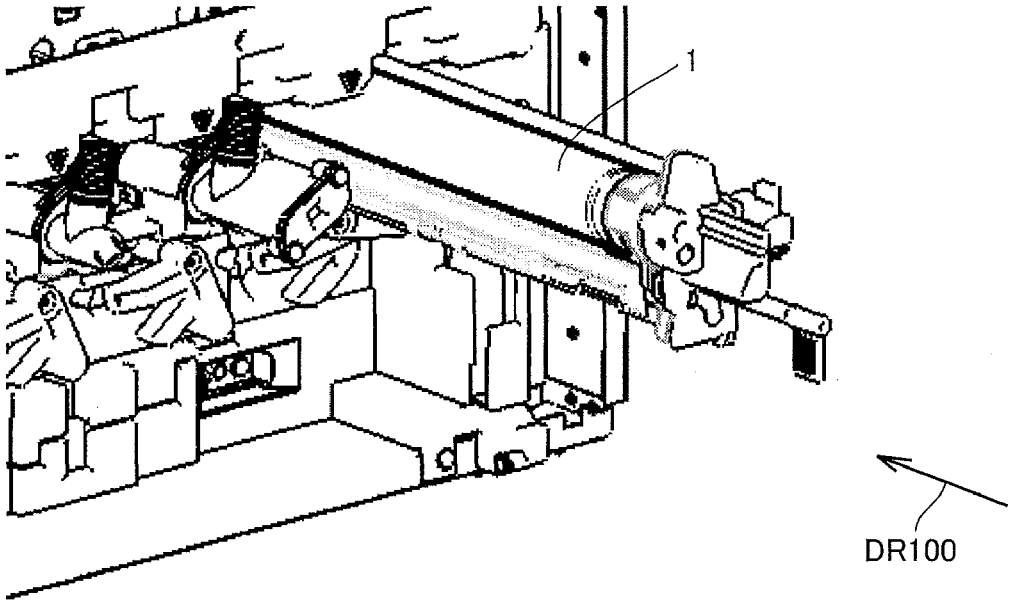
FIG. 7 is a diagram showing the third step of inserting a photoreceptor unit according to one embodiment of the present invention into an image forming apparatus.

Then, the procedure of attaching photoreceptor unit 100 according to the present embodiment to the image forming apparatus will be described with reference to FIGS. 5-7.

Figure 5:
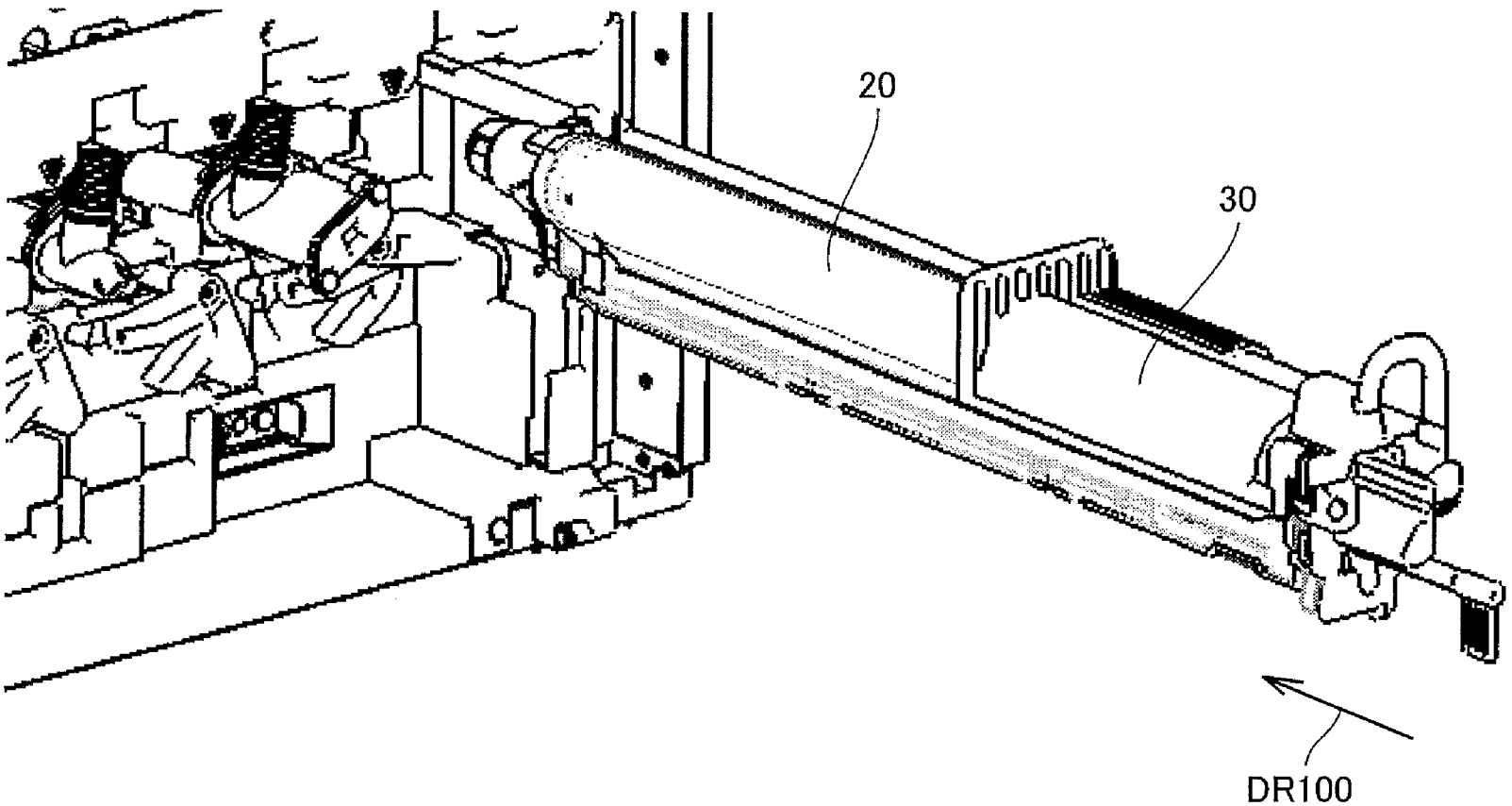
FIG. 5 is a diagram showing the first step of inserting a photoreceptor unit according to one embodiment of the present invention into an image forming apparatus.

As shown in FIG. 5, photoreceptor unit 100 having light-shielding sheet 20 and rigid cover 30 attached thereto is first inserted into the body of the image forming apparatus in the direction of an arrow DR100. This causes a flange portion 31 provided at the front end of rigid cover 30 to come into contact with the body of the image forming apparatus, as shown in FIG. 6. Flange portion 31 serves as a member for preventing rigid cover 30 from being excessively inserted into the body of the image forming apparatus. In the state shown in FIG. 6, rigid cover 30 is pulled to collectively remove the packaging materials of photoreceptor unit 100. In this case, light-shielding sheet 20, rigid cover 30 and cushioning member 40 are integrally provided, and therefore, can be removed together from photoreceptor unit 100. After these packaging materials are removed, as shown in FIG. 7, photoreceptor unit 100 is further inserted into the image forming apparatus (in the direction of arrow DR100).

Figure 9:
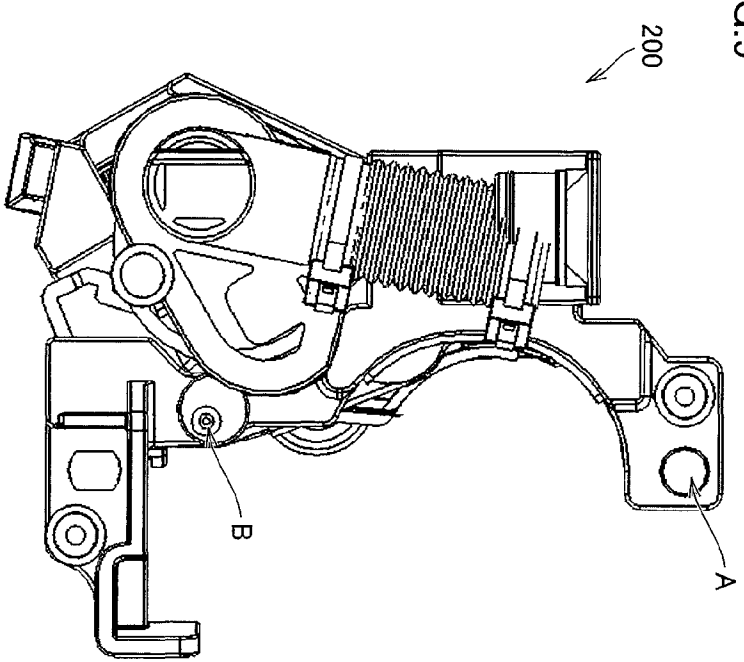
FIG. 9 is a diagram of a developing unit combined with a photoreceptor unit according to one embodiment of the present invention.
Figure 10:
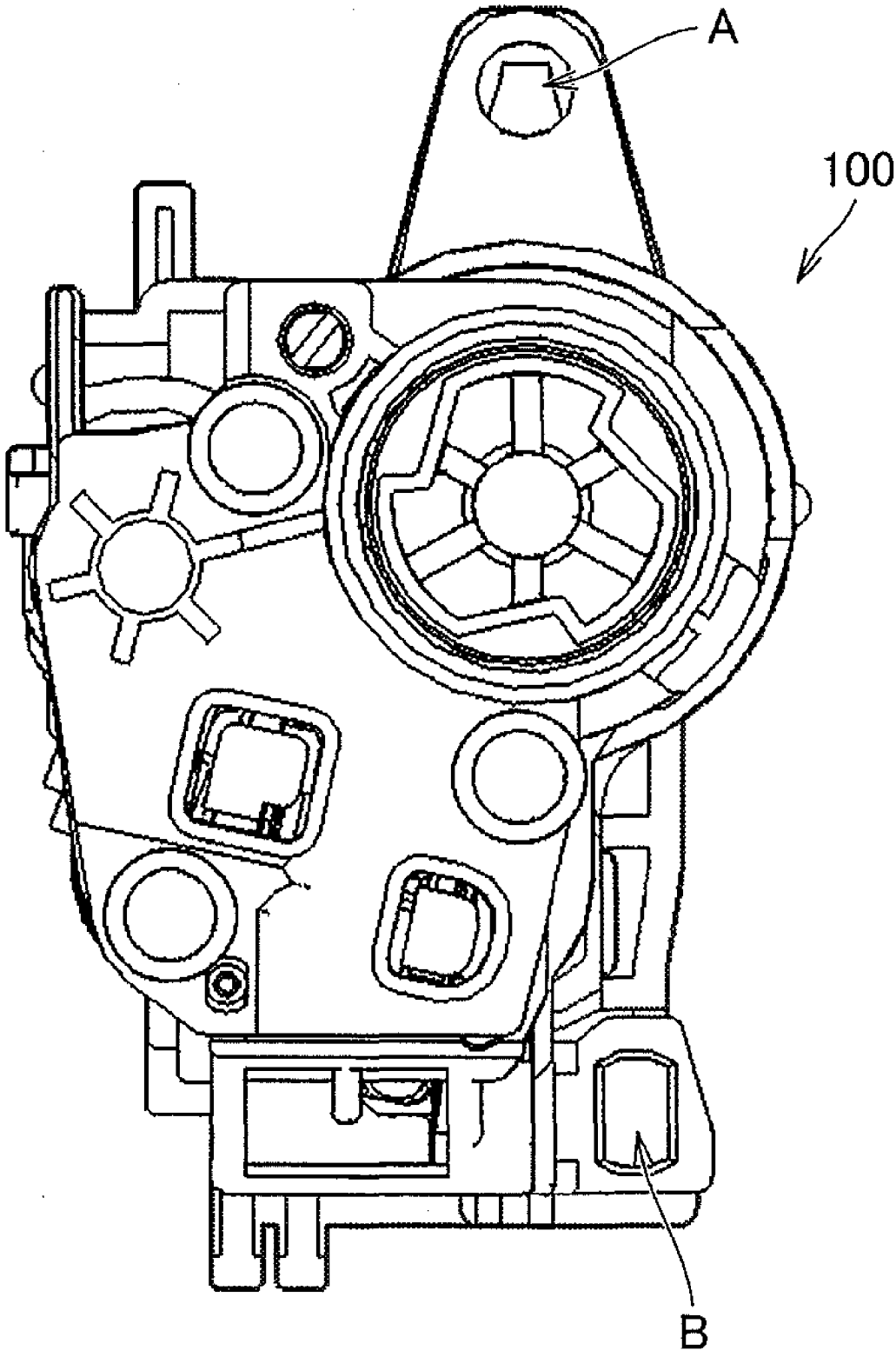
FIG. 10 is a diagram of a photoreceptor unit according to one embodiment of the present invention.

The combination of the photoreceptor unit and the developing unit will then be described with reference to FIGS. 8-10.

Figure 8:
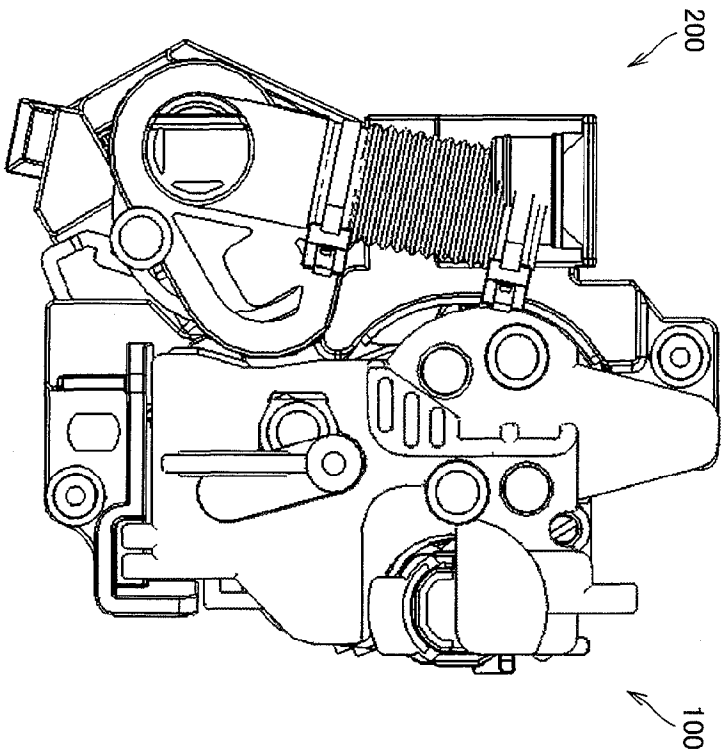
FIG. 8 is a diagram showing the state where a photoreceptor unit according to one embodiment of the present invention is combined with a developing unit.

As shown in FIG. 8, photoreceptor unit 100 according to the present embodiment is located adjacent to a developing unit 200 provided separately therefrom. Developing unit 200 and photoreceptor unit 100 are relatively positioned on "A" and "B" each shown in FIG. 9 (developing unit 200) and FIG. 10 (photoreceptor unit 100).

Figure 11:
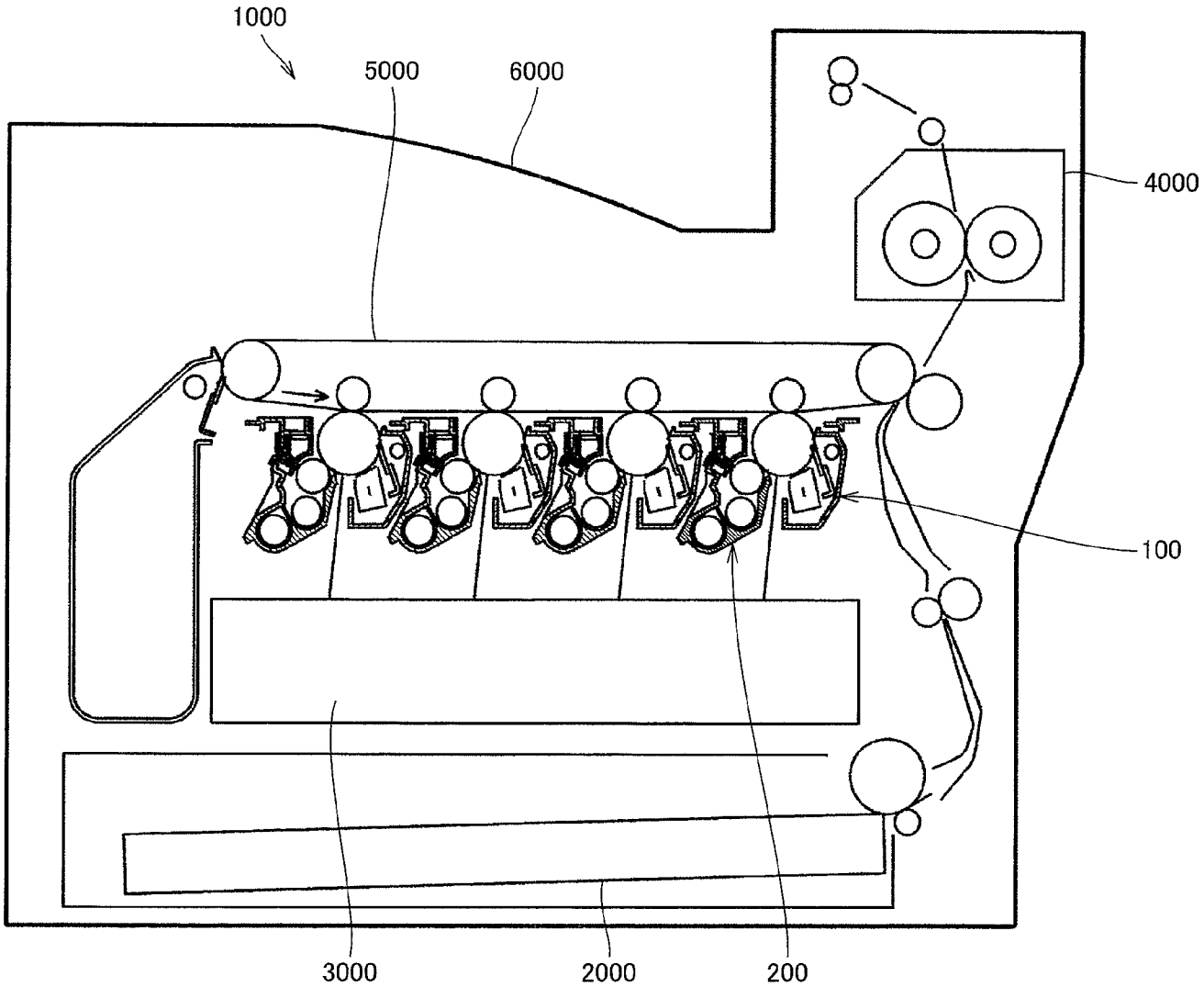
FIG. 11 is a diagram showing the entire configuration of an image forming apparatus equipped with a photoreceptor unit according to one embodiment of the present invention.

FIG. 11 is a diagram showing the entire configuration of an image forming apparatus 1000 equipped with a photoreceptor unit 100. Referring to FIG. 11, image forming apparatus 1000 corresponds to, for example, a copier, a printer, a facsimile machine and the like, and serves to form a predetermined image on a sheet of paper 2000.

Image forming apparatus 1000 includes an exposure unit 3000, a fixing unit 4000, a transfer belt 5000, and a paper discharge tray 6000. Furthermore, image forming apparatus 1000 includes photoreceptor unit 100 and developing unit 200 described above.

On photoreceptor 1 in photoreceptor unit 100, an electrostatic latent image having a desired pattern is formed by exposure unit 3000. Developing unit 200 which is disposed facing photoreceptor unit 100 supplies toner onto photoreceptor 1 to develop the above-mentioned electrostatic latent image. Thus, a toner image having a desired pattern is formed on photoreceptor 1 by developing unit 200.

The toner images on their respective photoreceptors are sequentially transferred and superimposed on transfer belt 5000, and collectively re-transferred onto the conveyed sheet of paper 2000. The toner image transferred onto sheet of paper 2000 is fixed in fixing unit 4000. Sheet of paper 2000 is then discharged onto paper discharge tray 6000. Thus, the image having a desired pattern is formed on sheet of paper 2000.

As described above, photoreceptor unit 100 according to the present embodiment facilitates convenient handling at the time of exchange while allowing sufficient protection of the photoreceptor, and also allows resource saving. Furthermore, since there is no need to ensure a space for temporarily accommodating rigid cover 30, the structure of the body of the image forming apparatus can be simplified.

It is to be noted that the same configuration as that of photoreceptor unit 100 according to the present embodiment can be applied to any image forming apparatus.

Although an example of photoreceptor 1 covered entirely in the axial direction with light-shielding sheet 20 and rigid cover 30 has been described in the present embodiment, photoreceptor 1 may be partially exposed.

Furthermore, although an example of photoreceptor unit 100 provided separately from developing unit 200 has been described in the present embodiment, the idea of the present invention can also be applied to the case where photoreceptor unit 100 and developing unit 200 are integrally provided.

Furthermore, although an example in which flange portion 31 is formed at the end of rigid cover 30 and is capable of preventing photoreceptor unit 100 equipped with rigid cover 30 from being excessively inserted into image forming apparatus 1 has been described in the present embodiment, flange portion 31 does not necessarily need to be formed.

It is to be noted that the "electrostatic charging unit" is not limited to an electrostatic charger, but may be a charging roller. The "cleaning unit" is not limited to a cleaner blade, but may be a cleaning brush.

The above description will be summarized as below. A photoreceptor unit according to the present embodiment is inserted into an image forming apparatus in the predetermined insertion direction (the direction of an arrow DR100), and includes a photoreceptor 1, a light-shielding sheet 20 covering a part of photoreceptor 1 on the front side in the insertion direction; a rigid cover 30 made of resin and provided adjacent to light-shielding sheet 20 on the rear side in the insertion direction; and a cushioning member 40 interposed between rigid cover 30 and photoreceptor 1. Rigid cover 30 has a length that allows photoreceptor unit 100 to be gripped at rigid cover 30. Light-shielding sheet 20, rigid cover 30 and cushioning member 40 can be removed together from photoreceptor 1. It is to be noted that rigid cover 30 may be provided so as to partially overlap light-shielding sheet 20.

In other words, the photoreceptor unit according to the present embodiment includes a photoreceptor 1; a housing 2 pivotally supporting photoreceptor 1 such that photoreceptor 1 can rotate and covering photoreceptor 1 in the state where at least a part of photoreceptor 1 is exposed; a light-shielding sheet 20 located in photoreceptor 1 on the front side in the insertion direction (the direction of an arrow DR100) and detachably attached to housing 2 so as to cover the portion of photoreceptor 1 exposed from housing 2; a rigid cover 30 connected to light-shielding sheet 20, located in photoreceptor 1 on the rear side in the insertion direction and detachably attached to housing 2 so as to cover the portion of photoreceptor 1 exposed from housing 2; and a cushioning member 40 interposed between rigid cover 30 and photoreceptor 1.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A photoreceptor unit for inserting into an image forming apparatus in a predetermined insertion direction, comprising:
- a photoreceptor;
- a light-shielding sheet covering a part of said photoreceptor;
- a rigid cover provided to overlap a first portion of said light-shielding sheet wherein a second portion of the light shielding sheet is not overlapped by the rigid cover; and
- a cushioning member interposed between said rigid cover and said photoreceptor,
- said rigid cover having a length allowing said photoreceptor unit to be gripped at said rigid cover, and
- said light-shielding sheet, said rigid cover and said cushioning member being removable together from said photoreceptor.

2. The photoreceptor unit according to claim 1, wherein said photoreceptor is covered in an axial direction with said light-shielding sheet and said rigid cover.

3. The photoreceptor unit according to claim 1, wherein said photoreceptor unit is provided separately from a developing unit for developing an electrostatic latent image formed on said photoreceptor.

4. The photoreceptor unit according to claim 1, wherein more than half of a surface of said photoreceptor is exposed in a state where said light-shielding sheet, said rigid cover and said cushioning member are removed.

5. The photoreceptor unit according to claim 1, wherein a flange portion is formed at an end of said rigid cover, said flange portion for preventing said photoreceptor unit equipped with said rigid cover from being excessively inserted into said image forming apparatus.

6. The photoreceptor unit according to claim 1, wherein said rigid cover has an axial length of not less than one-third and not more than two-thirds of an entire length of said photoreceptor.

7. An image forming apparatus comprising the photoreceptor unit according to claim 1.

8. A photoreceptor unit for inserting into an image forming apparatus in a predetermined insertion direction, comprising:
- a photoreceptor;
- a housing pivotally supporting said photoreceptor such that said photoreceptor can rotate and covering said photoreceptor in a state where at least a part of said photoreceptor is exposed;
- a light-shielding sheet located in said photoreceptor and detachably attached to said housing so as to cover a portion of said photoreceptor exposed from said housing;
- a rigid cover connected to said light-shielding sheet, located in said photoreceptor and detachably attached to said housing so as to cover a first portion of said photoreceptor exposed from said housing wherein a second portion of the light shielding sheet is not covered by the rigid cover; and
- a cushioning member interposed between said rigid cover and said photoreceptor.

9. The photoreceptor unit according to claim 8, wherein a part of a circumference of said photoreceptor is exposed in an axial direction from said housing.

10. The photoreceptor unit according to claim 8, further comprising a cleaning unit attached to said housing and scraping toner off a peripheral surface of said photoreceptor.

11. The photoreceptor unit according to claim 8, further comprising:
- a cleaning unit attached to said housing and scraping toner off a peripheral surface of said photoreceptor; and
- an electrostatic charging unit attached to said housing and electrostatically charging said photoreceptor.

12. The photoreceptor unit according to claim 8, wherein a flange portion is formed at an end of said rigid cover, said flange portion for preventing said photoreceptor unit equipped with said rigid cover from being excessively inserted into said image forming apparatus.

13. An image forming apparatus comprising the photoreceptor unit according to claim 8.

* * * * *